US010046221B2

(12) United States Patent
Ye et al.

(10) Patent No.: US 10,046,221 B2
(45) Date of Patent: Aug. 14, 2018

(54) HIGHLY-SIMULATED HORSEBACK RIDING MACHINE

(71) Applicant: Wuhan Bailih Sports Equipment Co., Ltd, Wuhan, Hubei Province (CN)

(72) Inventors: Changqing Ye, Wuhan (CN); Liang Pan, Wuhan (CN); Jiasheng Le, Wuhan (CN)

(73) Assignee: Wuhan Bailih Sports Equipment Co., Ltd., Wuhan, Hubei Province (CN)

( * ) Notice: Subject to any disclaimer, the term of this patent is extended or adjusted under 35 U.S.C. 154(b) by 0 days.

(21) Appl. No.: 15/668,174

(22) Filed: Aug. 3, 2017

(65) Prior Publication Data

US 2018/0050252 A1 Feb. 22, 2018

(30) Foreign Application Priority Data

Aug. 18, 2016 (CN) ..... 2016 1 0685786

(51) Int. Cl.

| | |
|---|---|
| ***A63B 69/04*** | (2006.01) |
| ***A63G 13/08*** | (2006.01) |
| ***A63B 26/00*** | (2006.01) |
| *A63B 23/02* | (2006.01) |

(52) U.S. Cl.

CPC ..... *A63B 69/04* (2013.01); *A63B 26/003* (2013.01); *A63G 13/08* (2013.01); *A63B 23/0211* (2013.01)

(58) Field of Classification Search

CPC ..... A63G 13/00; A63G 13/06; A63G 13/08; A63G 15/00; A63G 19/00; A63G 19/20; A63B 9/00; A63B 9/04; A63B 69/00; A63B 69/0068; A63B 69/04

USPC ..... 472/96–99, 101; 434/247; 482/51, 54, 482/57, 61

See application file for complete search history.

(56) References Cited

U.S. PATENT DOCUMENTS

| | | | | |
|---|---|---|---|---|
| 2,634,975 | A * | 4/1953 | Hahs | A63G 19/20 472/97 |
| 6,808,458 | B1 * | 10/2004 | Jung | A63B 69/04 434/247 |
| 7,070,415 | B2 * | 7/2006 | Hojo | A63B 26/003 434/247 |
| 7,736,240 | B2 * | 6/2010 | Chuang | A63B 69/04 434/247 |

(Continued)

*Primary Examiner* — Kien Nguyen

(74) *Attorney, Agent, or Firm* — Muncy, Geissler, Olds & Lowe, P.C.

(57) ABSTRACT

The present invention relates to a highly-simulated horseback riding machine, comprising supporting horse feet, a horse head, a horse hide, and a saddle. A movement mechanism is disposed within the horse hide, which comprises a base, a motor, a crank, a connecting rod, and a swing arm. Two ends of the connecting rod are hinged to the crank and the swing arm, respectively. The sum of length of the crank and the length the swing arm is less than the length of the connecting rod, and the length of the crank is less than that of the swing arm; the lower end of the swing arm is fixed to the base, and the fixed position of the lower end of the swing arm is higher than the position of the highest point of the crank in the process of rotation; the saddle is fixed to the connecting rod by means of a vertical rod; and the base is supported by the horse feet. The horse feet are in a double-splayed form so as to ensure that the horseback riding machine may not bounce unexpectedly in motion.

6 Claims, 4 Drawing Sheets

(56) References Cited

U.S. PATENT DOCUMENTS

| | | | | |
|---|---|---|---|---|
| 2008/0171606 | A1* | 7/2008 | Chuang | A63B 69/0068 472/97 |
| 2008/0200271 | A1* | 8/2008 | Chuang | A63B 69/0068 472/97 |

* cited by examiner

HIGHLY-SIMULATED HORSEBACK RIDING MACHINE

TECHNICAL FIELD

The present invention relates to the fitness equipment, and more specifically, to a highly-simulated horseback riding machine.

BACKGROUND ART

Horseback riding is an outdoor exercise that may allow a person to work out and get close to nature, and thus is a very beneficial exercise. However, due to high cost of horseback riding, this exercise is less popular.

Various horseback riding machines are available on the market, including active horseback riding machines and passive horseback riding machines. Motion trajectories of horseback riding machine products available on the market are mainly horizontally elliptical or figure-eight-shaped, and lack rhythm control with great differences from the characteristics of the actual horseback riding motion. The existing various horseback riding machines have a common problem of low similarity to real horseback riding in motion characteristics, and thus may not give a user the use experience of simulating horseback riding and also hardly achieve the desired effect of keeping fit.

SUMMARY OF THE INVENTION

The technical problem to be solved by the present invention is to provide a highly-simulated horseback riding machine.

In the present invention, the following technical solution is used to solve the technical problem thereof: a highly-simulated horseback riding machine is constructed, which comprises supporting horse feet, a horse head, a horse hide, and a saddle. A movement mechanism is disposed within the horse hide, and comprises a base, a motor, a crank, a connecting rod, and a swing arm; two ends of the connecting rod are hinged to the crank and the swing arm, respectively; the sum of length of the crank and the length of the swing arm is less than the length of the connecting rod, and the length of the crank is less than that of the swing arm; a lower end of the swing arm is fixed to the base; the motor is mounted on the base, and drives the crank to rotate; the fixed position of the lower end of the swing arm is higher than the position of the highest point of the crank in the process of rotation; the saddle is fixed to the connecting rod by means of a vertical rod; and the supporting horse feet are used for supporting the base.

In the above-described solution, the motor is connected to a multi-wedged pulley group by means of multi-wedged belts; and one end of the crank is fixed to the multi-wedged pulley group.

In the above-described solution, a hand grab is disposed at the front end of the saddle; a lower end of the hand grab is connected to a horse head supporting rod that is hinged to the horse head; and the horse head and the horse head supporting rod are also connected by means of a return spring.

In the above-described solution, a horse mouth is disposed at the front end of the horse head, which is connected to a bridle rein.

In the above-described solution, the supporting feet include four horizontal rods in a splayed form, and adjustable supporting feet are disposed at the bottoms of the horizontal rods.

In the above-described solution, an electronic meter is mounted on the saddle.

Implementation of the highly-simulated horseback riding machine in the present invention may produce the following beneficial effects:

with the movement mechanism in the horseback riding machine in the present invention, the motion trajectory at the saddle is made similar to an ellipse slantwise downwards with achieved characteristic of being slow at the highest and lowest positions in the process of motion and speed varies at the highest and lowest positions. As compared with the actual horseback riding, the simulation similarity is above 80%, because in the horse riding process, a rider must keep consistent with the trajectory changing and speed changing rhythm of the horse, and achieves the purpose of working out with the changing of speed and frequency.

BRIEF DESCRIPTION OF THE DRAWINGS

The present invention will be further described below in conjunction with figures and embodiments. In the figures.

DETAILED DESCRIPTION OF THE PREFERRED EMBODIMENTS

To provide a clearer understanding of the technical features, objectives and effects of the present invention, detailed descriptions will be made now to specific embodiments of the present invention with reference to the figures.

As shown in FIG. 1 to FIG. 9, a highly-simulated horseback riding machine in the present invention comprises supporting horse feet, a horse head 1, a horse hide 16, and a saddle 6. A movement mechanism and a horse frame 18 for supporting the horse hide 16 are disposed within the horse hide 16.

Figure 1:
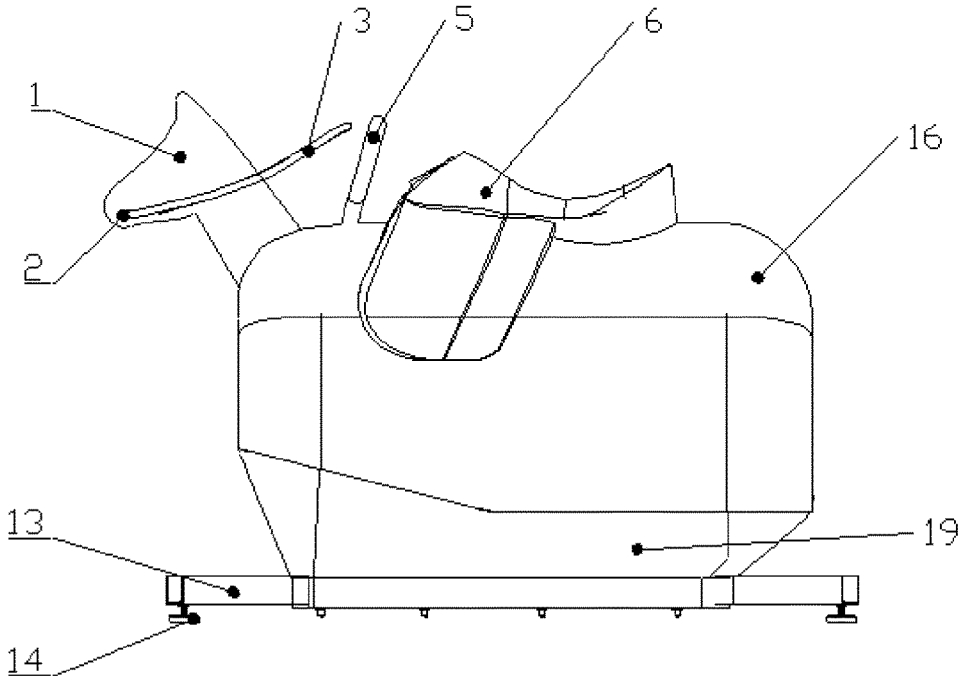
FIG. 1 is a structural diagram of a highly-simulated horseback riding machine in the present invention.
Figure 2:
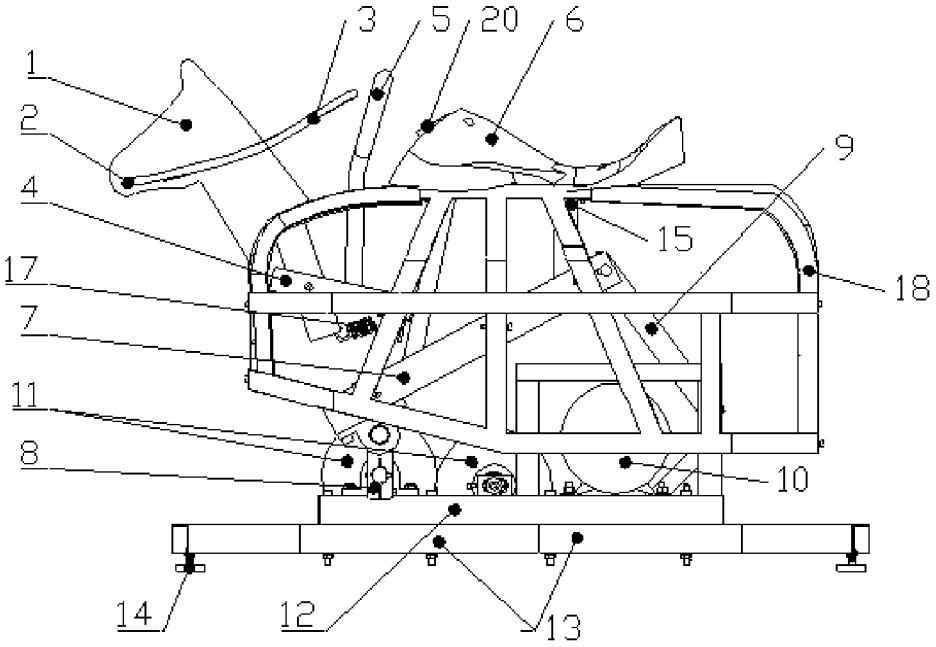
FIG. 2 is an internal structural diagram of the highly-simulated horseback riding machine in the present invention.
Figure 3:
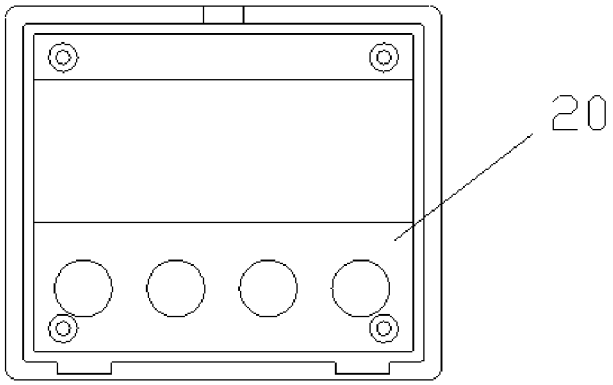
FIG. 3 is a structural diagram of a meter.

The movement mechanism comprises a base 12, a motor 10, a crank 8, a connecting rod 7, and a swing arm 9. The schematic diagram of the movement mechanism is as shown in FIG. 3. Two ends of the connecting rod 7 are hinged to the crank 8 and the swing arm 9, respectively. The sum of length of the crank 8 and the length of the swing arm 9 is less than the length of the connecting rod 7. A lower end of the swing arm 9 is fixed to the base 12. The motor 10 is mounted on the base 12, and drives the crank 8 to rotate. The saddle 6 is fixed to the connecting rod 7 by means of a vertical rod 15. The supporting horse feet are used for supporting the base 12. An electronic meter 20 is mounted on the saddle 6. The machine can be started only after authorization of password by the electronic meter 20. The motor 10 has 17 gears in total, and the gears may be controlled by adjusting a button on the electronic meter 20 so as to simulate different speeds of a horse when moving.

Further, a covering cloth 19 is disposed on the lower portion of the horse hide 16. The upper portion of the covering cloth 19 is bonded to the lower edge of the inner side of the horse hide 16 by means of magic tapes, and the lower edge of the same is fixed to the part between the supporting horse feet and the base 12. The covering cloth 19 may cover mechanical parts therein.

Figure 4:
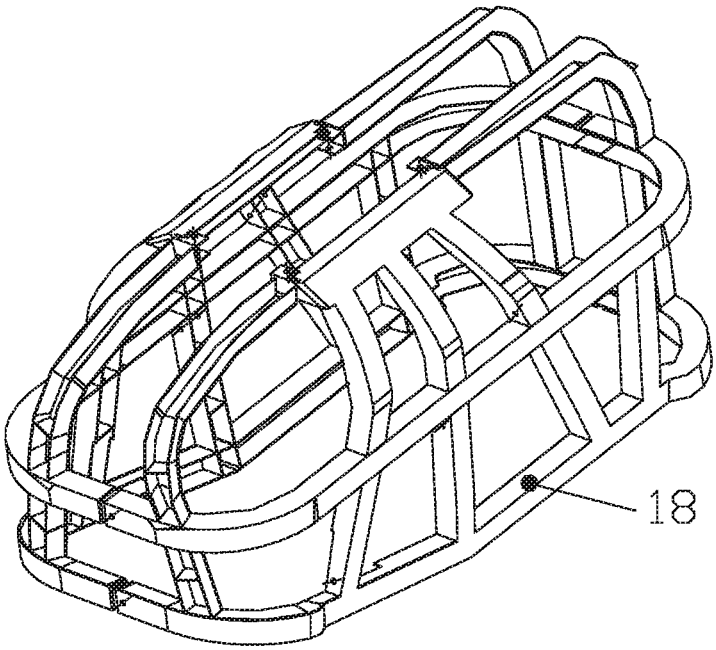
FIG. 4 is a structural diagram of a horse frame.
Figure 5:
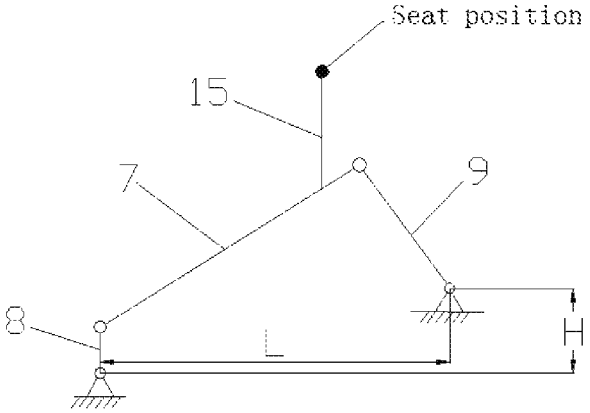
FIG. 5 is a schematic diagram of a movement mechanism.

In this embodiment, the crank 8 rotates clockwise. In an overall consideration of the structure size of the product, the total length of the horse hide is about 1000 mm; in the process of motion, the maximum value of the total height of a hip sitting point on the saddle above the ground is about 780 mm; and the horizontal distance L between fixed points of a fixed-point rocker arm of the crank 8 is 510 to 580 mm, and preferably, 530 mm. The position for a person to sit is close to ⅙ to ⅐ position of the right end of the connecting rod 7, which is the ⅐ position in this embodiment. The sum of length of the crank and the length of the rocker arm is less than the length of the connecting rod 7, and the length of the crank 8 is less than that of the swing arm 9. To achieve a pitch-down effect in horseback riding, the fixed position of the lower end of the swing arm 9 is higher than the position of the highest point of the crank 8 in the process of rotation, and the height H thereof is 1.5 to 2 times the length of the crank 8; also, in order to control the saddle to swing back and forth, the length of the crank 8 is 50 to 100 mm, and preferably 70 mm. The length of the rocker arm is 3 to 5 times, and preferably, 4 times that of the crank 8; and the length of the vertical rod 15 is 2-3 times, and preferably, 2.5 times that of the crank 8. As shown in FIG. 4, the saddle 6 has a maximum motion distance of 100 mm in the horizontal direction, a maximum motion distance of 117 mm in the vertical direction, and in the process of motion, a pitch-down angle of about 8 degrees and a lean-back angle of about 8 degrees, thereby guaranteeing the similarity to real horseback riding.

Figure 6:
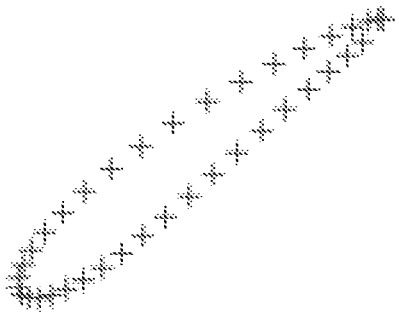
FIG. 6 is a diagram of a motion trajectory of the highly-simulated horseback riding machine in the present invention.
Figure 7:
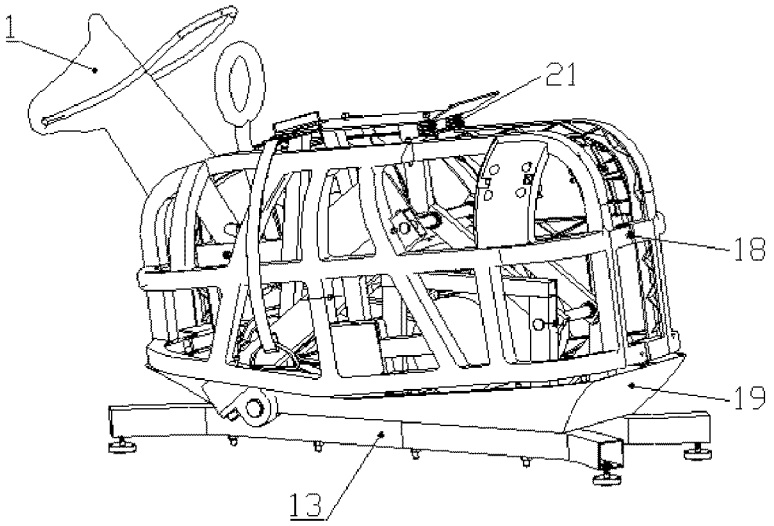
FIG. 7 is a diagram for a damping spring being mounted at the bottom of a saddle.
Figure 8:
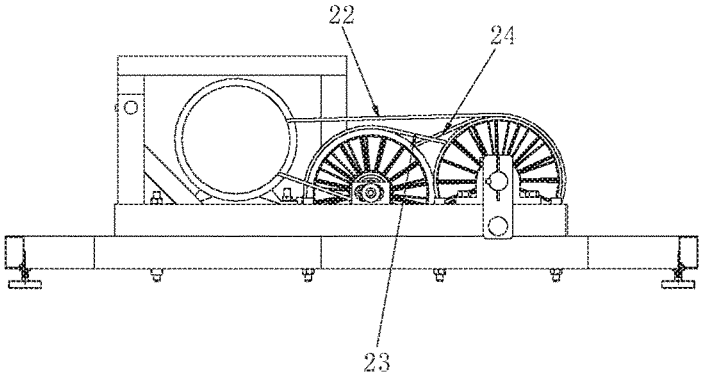
FIG. 8 is a structural diagram of a multi-wedged pulley group.
Figure 9:
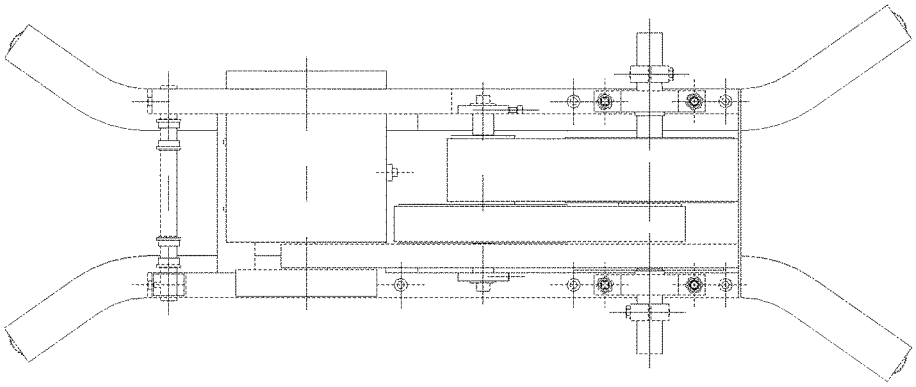
FIG. 9 is a top view of FIG. 8.

As shown in FIG. 6, each point interval is an equal time slot; there are a plurality of points concentrated at the top and bottom of this motion, which indicates lower speeds of motion at both positions; and points are far away from one another and sparse in the middle position, which indicates faster motion of the mechanism at this position, thereby achieving the motion characteristic of fast up and fast down. It may be found by observing these points that the up and down speeds of this motion are 2 to 4 times the speed when stopping. Compared with the actual horseback riding motion, the present invention patent achieves a simulation similarity of above 80%.

Further, the motor 10 is connected to a multi-wedged pulley group 11 by means of multi-wedged belts. One end of the crank 8 is fixed to the multi-wedged pulley group 11. Slowing-down is achieved by means of the multi-wedged pulley group 11. The motor 10 may be a variable-frequency and variable-speed motor 10 for controlling speeds. The multi-wedged pulley group 11 comprises a first-stage speed reduction pulley, a second-stage speed reduction pulley and a third-stage speed reduction pulley that are all made of a nylon material. The motor is connected to the first-stage speed reduction pulley by means of a first-stage multi-wedged belt 22; the first-stage speed reduction pulley is connected to the second-stage speed reduction pulley by means of a second-stage multi-wedged belt 23; and the second-stage speed reduction pulley is connected to the third-stage speed reduction pulley by means of a third-stage multi-wedged belt 24. The total drive ratio of the whole machine is 26:1. The first-stage multi-wedged belt is 10-wedged PJ type belt, while the second-stage multi-wedged belt is 8-wedged PL type belt, and the third-stage multi-wedged belt is 14-wedged PL type belt.

Further, a hand grab 5 is disposed at the front end of the saddle 6. The lower end of the hand grab 5 is connected to a horse head supporting rod 4 that is hinged to the horse head 1. The horse head 1 and the horse head supporting rod 4 are also connected by means of a return spring 17. A horse mouth 2 is disposed at the front end of the horse head 1, which is connected to a bridle rein 3. The horse head 1 may be turned by pulling the bridle rein 3 with the return spring 17 being extended to produce a restoring force.

Further, a damping spring 21 is disposed at the bottom of the saddle 6 for shock absorption.

Further, the supporting horse feed include horizontal rods 13 and adjusting feet 14 in a splayed form with the adjusting feet 14 being disposed on the bottoms of the horizontal rods 13. The horizontal rods 13 may be four short pipes or two long pipes. A distance between the adjusting feet 14 at the front and back is about 1000 mm; the front adjusting foot 14 extends out of the base a length of about 172 mm, while the rear adjusting foot 14 extends out of the base a length of about 140 mm; and the left-and-right splaying width of the adjusting feet 14 is about 387 mm, ensuring that the horseback riding machine may not bounce unexpectedly in the horseback riding process, thereby guaranteeing that the whole machine can operate steadily in the process of motion.

The embodiments of the present invention are described above in conjunction with the figures, but the present invention is not limited to the above-described specific embodiments that are merely schematic rather than limiting. Many forms may also be made by those of ordinary skill in the art under the teaching of the present invention without departing from the objective of the present invention and the scope of protection defined by claims; and they shall all fall into the protection scope of the present invention.

The invention claimed is:

1. A highly-simulated horseback riding machine, comprising supporting horse feet, a horse head, a horse hide, and a saddle, with a movement mechanism being disposed within the horse hide-, wherein the movement mechanism comprises a base, a motor, a crank, a connecting rod, and a swing arm; two ends of the connecting rod are hinged to the crank and the swing arm, respectively; the sum of length of the crank and the length of the swing arm is less than the length of the connecting rod, and the length of the crank is less than that of the swing arm; a lower end of the swing arm is fixed to the base; the motor is mounted on the base, and drives the crank to rotate; the fixed position of the lower end of the swing arm is higher than the position of the highest point of the crank in the process of rotation; the saddle is fixed to the connecting rod by means of a vertical rod; and the supporting horse feet are used for supporting the base.

2. The highly-simulated horseback riding machine according to claim 1, wherein the motor is connected to a multi-wedged pulley group by means of multi-wedged belts; and one end of the crank is fixed to the multi-wedged pulley group.

3. The highly-simulated horseback riding machine according to claim 1, wherein a hand grab is disposed at the front end of the saddle; a lower end of the hand grab is connected to a horse head supporting rod that is hinged to the horse head; and the horse head and the horse head supporting rod are also connected by means of a return spring.

4. The highly-simulated horseback riding machine according to claim 3, wherein the supporting feet include four horizontal rods in a splayed form, and adjustable supporting feet are disposed at the bottoms of the horizontal rods.

5. The highly-simulated horseback riding machine according to claim 1, wherein a horse mouth is disposed at the front end of the horse head, which is connected to a bridle rein.

6. The highly-simulated horseback riding machine according to claim 1, wherein an electronic meter is mounted on the saddle.

* * * * *